US008622488B1

(12) United States Patent
Kilby et al.

(10) Patent No.: US 8,622,488 B1
(45) Date of Patent: Jan. 7, 2014

(54) VERTICALLY RETRACTABLE SHELF SYSTEM

(76) Inventors: Ronnie Kilby, Reva, VA (US); Cindy Kilby, Reva, VA (US)

( * ) Notice: Subject to any disclaimer, the term of this patent is extended or adjusted under 35 U.S.C. 154(b) by 454 days.

(21) Appl. No.: 12/941,259

(22) Filed: Nov. 8, 2010

(51) Int. Cl.
*A47F 5/08* (2006.01)

(52) U.S. Cl.
USPC ..... 312/247; 312/351.14; 211/103; 211/202

(58) Field of Classification Search
USPC ..... 312/101, 131, 132, 222, 245, 246, 247, 312/248, 306, 349, 351.11, 351.12, 351.13, 312/351.14; 211/87.01, 103, 187, 192, 200, 211/202; 292/137, 138, DIG. 15, 57, 58, 63, 292/64, 66; 248/429, 430
See application file for complete search history.

(56) References Cited

U.S. PATENT DOCUMENTS

| | | | | |
|---|---|---|---|---|
| 223,624 | A * | 1/1880 | de Witt | 292/57 |
| 1,463,511 | A * | 7/1923 | Lane | 312/248 |
| 2,639,042 | A | 5/1953 | Lambert et al. | |
| 3,485,544 | A | 12/1969 | Beckerman | |
| 3,923,347 | A | 12/1975 | Dean | |
| 4,088,380 | A * | 5/1978 | Watts | 312/237 |
| 4,289,292 | A * | 9/1981 | Kunjumon | 248/333 |
| 4,421,227 | A | 12/1983 | Kornylak | |
| 4,423,914 | A | 1/1984 | Vander Ley | |
| 4,573,748 | A * | 3/1986 | Biraghi et al. | 312/7.2 |
| 4,736,689 | A | 4/1988 | Stanko | |
| 5,467,954 | A * | 11/1995 | Wekell | 248/201 |
| 5,927,840 | A * | 7/1999 | Bzowski | 312/321.5 |
| 6,416,145 | B1 | 7/2002 | Singh | |
| 6,471,311 | B1 * | 10/2002 | Snyder | 312/247 |
| 6,676,233 | B1 * | 1/2004 | Evans et al. | 312/247 |
| 6,755,492 | B1 * | 6/2004 | Hyde et al. | 312/247 |
| 6,926,377 | B2 | 8/2005 | Lammens et al. | |
| 2003/0168951 | A1 * | 9/2003 | Holbrook et al. | 312/245 |
| 2008/0210118 | A1 * | 9/2008 | Chan et al. | 102/275.12 |
| 2009/0151380 | A1 * | 6/2009 | Oh et al. | 62/259.1 |

* cited by examiner

*Primary Examiner* — Darnell Jayne
*Assistant Examiner* — Sasha T Varghese
(74) *Attorney, Agent, or Firm* — Montgomery Patent & Design; Robert C. Montgomery

(57) ABSTRACT

A vertically retractable shelf system comprises a shelf frame and a track assembly. The shelf frame comprises a rectangular frame. The track assembly comprises a roller slide assembly, disposed on the left and right sides of the shelf frame, to allow the shelf frame to slide vertically along the tracks.

10 Claims, 7 Drawing Sheets

VERTICALLY RETRACTABLE SHELF SYSTEM

RELATED APPLICATIONS

The present invention was first described in a notarized Official Record of Invention on Sep. 25, 2009, that is on file at the offices of Montgomery Patent and Design, LLC, the entire disclosures of which are incorporated herein by reference.

FIELD OF THE INVENTION

The present invention relates generally to shelving units, and in particular, to a vertically deployable and retractable shelving unit.

BACKGROUND OF THE INVENTION

No matter how much storage space is provided in the typical home, there is always a need for more. The use of shelving units provides a means for storing many items along a single vertical surface; however, in many cases closets, cabinets, garages, basements, and storage sheds are still quickly filled to capacity. Any attempt to add additional storage space which is easily accessible quickly competes with living space in a typical home.

Any storage space created in inaccessible spaces is inconvenient to reach and often requires the use of a ladder or similar device to access. Furthermore, such inaccessible locations are a safety issue, particularly for children and older adults.

Various attempts have been made to provide overhead storage units. Examples of these attempts can be seen by reference to several U.S. patents. U.S. Pat. No. 3,485,544, issued in the name of Beckerman, describes an overhead storage apparatus which swings downward from a ceiling location in order to provide access to a plurality of storage compartments.

U.S. Pat. No. 6,851,376, issued in the name of D'Agostino, describes a pull down overhead storage shelf with a spring rewinding mechanism for returning the shelf to an upward location.

While these devices fulfill their respective, particular objectives, each of these references suffer from one (1) or more of the aforementioned disadvantages. Many such devices are difficult or dangerous to deploy or retract. Also, many such devices do not provide sufficient securement for contained objects during deployment and retraction, or may upset or damage those objects. Furthermore, many such devices are limited as to the amount of storage space they can provide. Accordingly, there exists a need for an overhead storage device without the disadvantages as described above. The development of the present invention substantially departs from the conventional solutions and in doing so fulfills this need.

SUMMARY OF THE INVENTION

In view of the foregoing references, the inventor recognized the aforementioned inherent problems and observed that there is a need for overhead storage which provides a significant amount of usable storage space in a manner which is secure and easy to deploy or retract. Thus, the object of the present invention is to solve the aforementioned disadvantages and provide for this need.

To achieve the above objectives, it is an object of the present invention to provide a vertically retractable shelving apparatus comprising a shelf enclosure and a track system.

Another object of the present invention is to mount to a vertical surface such as a door or wall.

Yet still another object of the present invention is to comprise the shelf enclosure of a plurality of shelves for storing a variety of objects.

Yet still another object of the present invention is to provide secure retention of objects stored within the apparatus. The shelf enclosure may further comprise a plurality of guide rails located along a front portion of each shelf in order to prevent accidental falling of the stored objects.

Yet still another object of the present invention is to comprise a handle which allows a user to pull the shelf enclosure downwardly along the track system. A rear surface of the enclosure comprises a pair of upper rollers and a pair of lower rollers which engage the track system to further facilitate movement of the shelf enclosure along the track system.

Yet still another object of the present invention is to allow the user to secure the shelf enclosure at a desired vertical position along the track system with a locking mechanism comprising a pivoting hook and a locking rod which the user may rotate to engage one of a plurality of catches located along an outer surface of the track system.

Yet still another object of the present invention is to comprise a plurality of springs which provide stabilization of the shelf enclosure along the track system. The track system comprises a pair of track enclosures which house the plurality of springs at an internal lower portion.

Yet still another object of the present invention is to provide a method of utilizing the device that provides a unique means of acquiring an instance of the apparatus, fastening the track system to a desired vertical surface, gripping the handle and motioning the shelf enclosure along the track system, utilizing the locking rod and hook to fix the shelf enclosure at a desired vertical position, and placing a desired variety and plurality of objects on the shelves of the apparatus for storage.

Further objects and advantages of the present invention will become apparent from a consideration of the drawings and ensuing description.

BRIEF DESCRIPTION OF THE DRAWINGS

The advantages and features of the present invention will become better understood with reference to the following more detailed description and claims taken in conjunction with the accompanying drawings, in which like elements are identified with like symbols, and in which:

Figure 1:
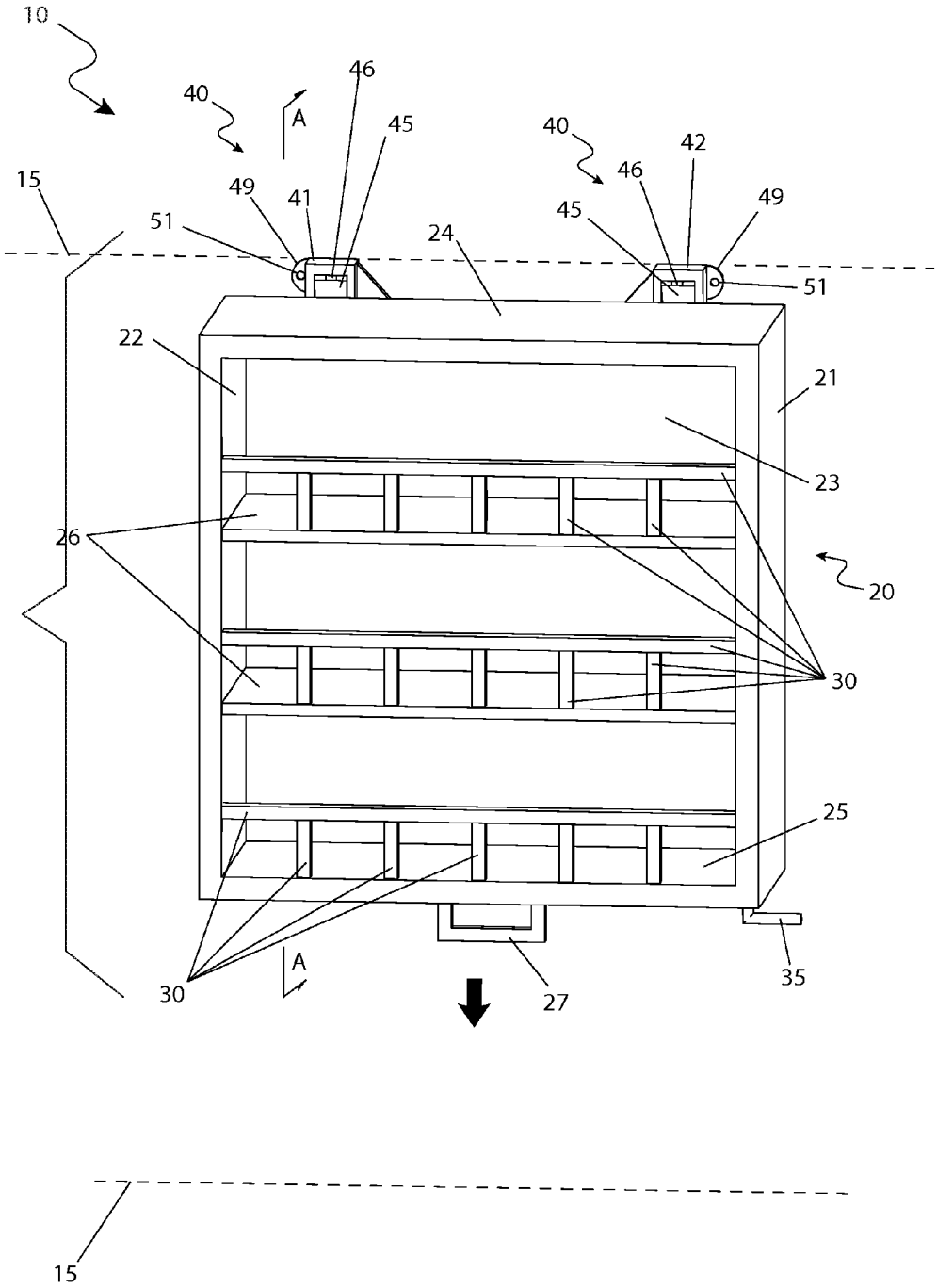
FIG. 1 is an environmental view of a vertically retractable shelf system 10, according to a preferred embodiment of the present invention.

| DESCRIPTIVE KEY | |
|---|---|
| 10 | vertically retractable shelf system |
| 15 | vertical surface |
| 20 | shelf enclosure |
| 21 | first side panel |
| 22 | second side panel |
| 23 | rear panel |
| 24 | upper panel |
| 25 | bottom panel |
| 26 | shelf |
| 27 | handle |
| 30 | guide rail |
| 31 | adhesive |
| 32 | upper roller |
| 33 | lower roller |
| 34 | axle |
| 35 | locking rod |
| 36 | hook |
| 37 | bracket |
| 38 | locking mechanism |
| 40 | track system |
| 41 | first track enclosure |
| 42 | second track enclosure |
| 43 | front surface |
| 44 | first opening |
| 45 | panel |
| 46 | hinge |
| 47 | second opening |
| 48 | linear opening |
| 49 | foot |
| 50 | aperture |
| 51 | fastener |
| 52 | catch |
| 53 | crossbar |
| 54 | spring |

DETAILED DESCRIPTION OF THE PREFERRED EMBODIMENT

The best mode for carrying out the invention is presented in terms of its preferred embodiment, herein depicted within FIGS. 1 through 7. However, the invention is not limited to the described embodiment and a person skilled in the art will appreciate that many other embodiments of the invention are possible without deviating from the basic concept of the invention, and that any such work around will also fall under scope of this invention. It is envisioned that other styles and configurations of the present invention can be easily incorporated into the teachings of the present invention, and only one particular configuration shall be shown and described for purposes of clarity and disclosure and not by way of limitation of scope.

The terms "a" and "an" herein do not denote a limitation of quantity, but rather denote the presence of at least one of the referenced items.

The present invention describes a vertically retractable shelf system (herein described as the "apparatus") 10, which provides a means for a retractable shelving means with enhanced features. The apparatus 10 comprises a pull-down spring-loaded feature which enables a user to access items stored on said apparatus 10 without common step stools or ladders. The apparatus 10 also comprises a shelf enclosure 20 and a track system 40. The apparatus 10 is preferably mounted to a vertical surface 15 such as, but not limited to: a wall, a door, or the like. The apparatus 10 is fabricated from materials such as, but not limited to: wood, plastic, steel, or the like.

Figure 2:
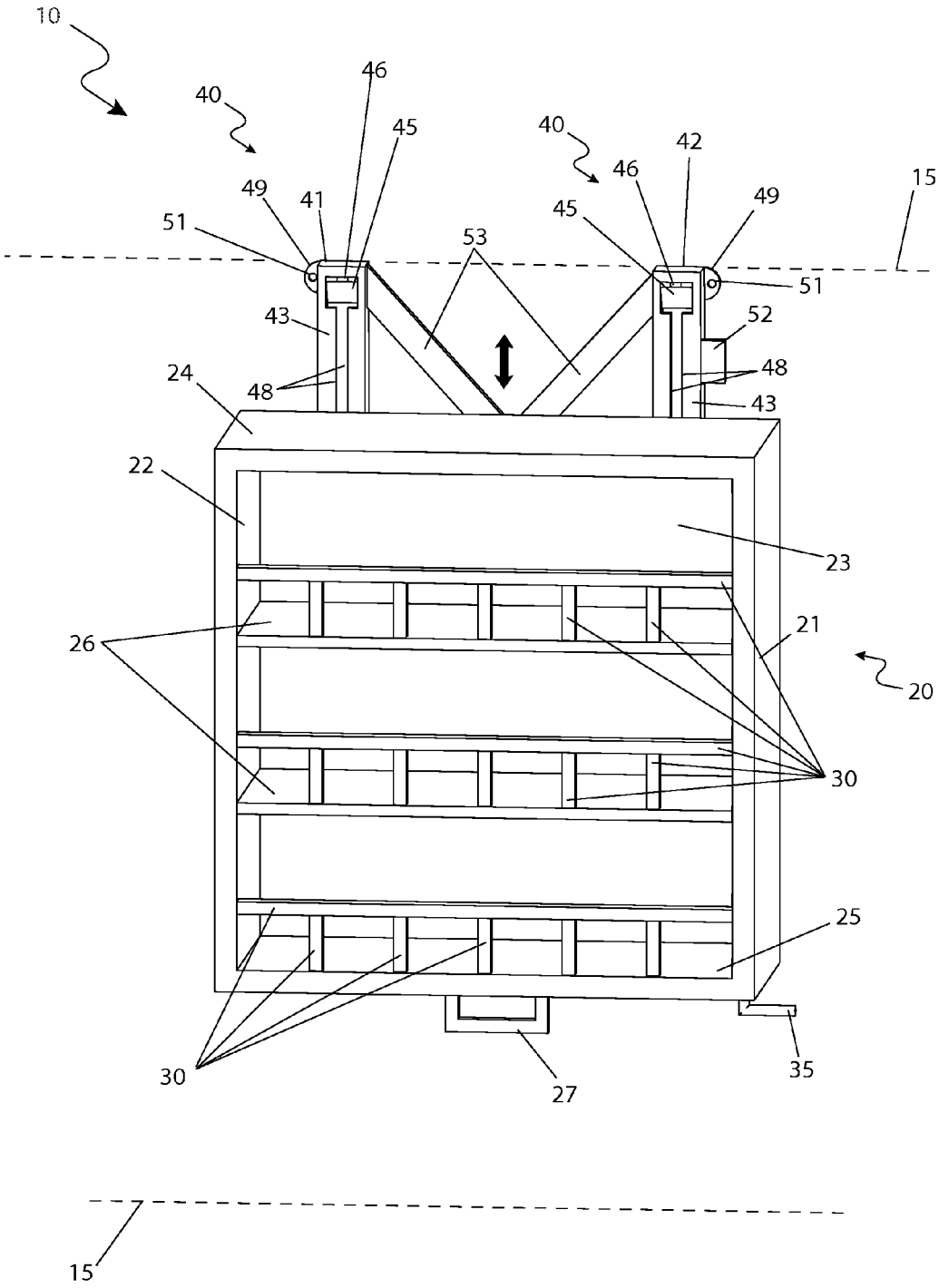
FIG. 2 is another environmental view of the vertically retractable shelf system 10 depicting a deployed state, according to a preferred embodiment of the present invention.
Figure 3:
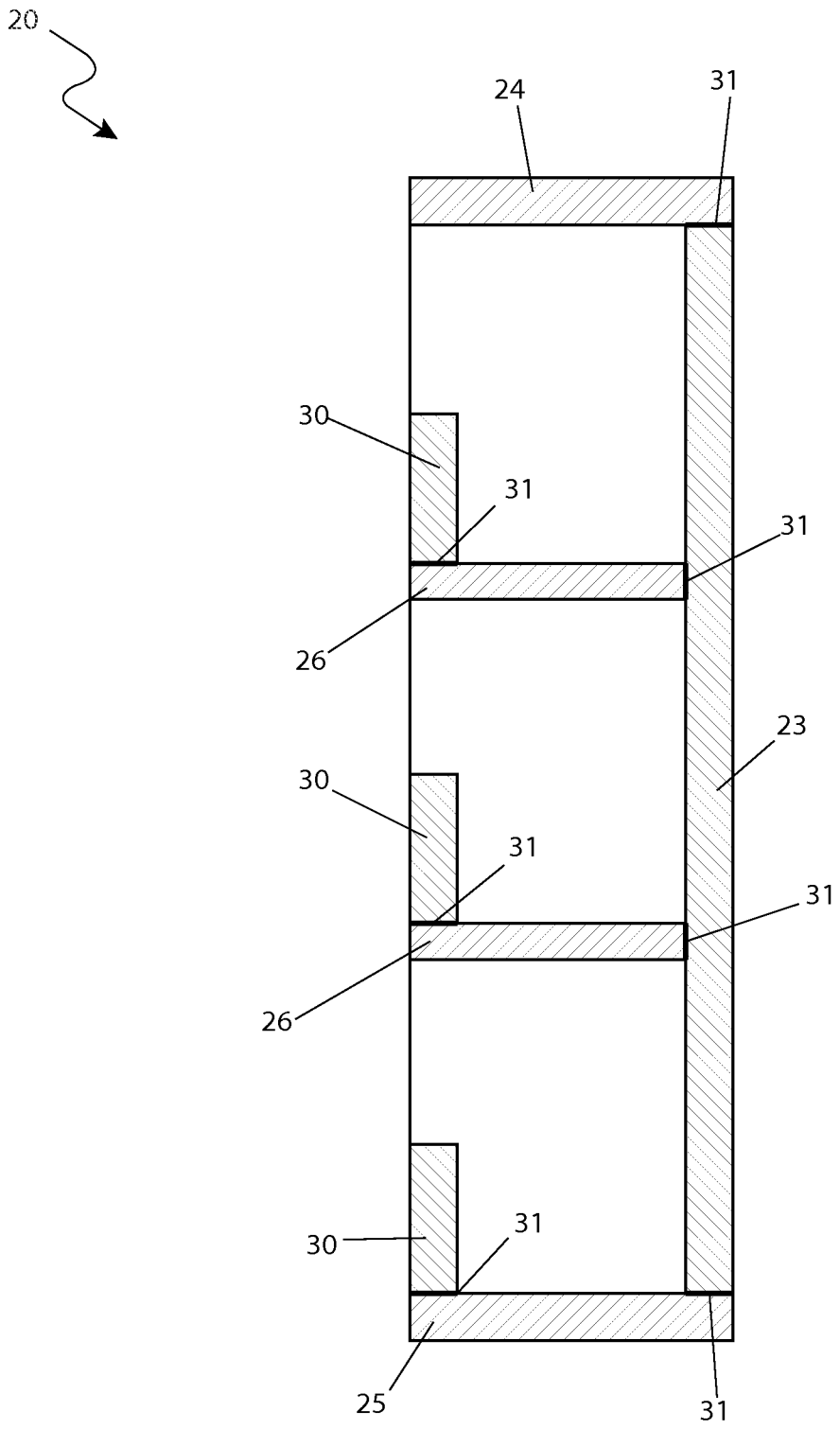
FIG. 3 is a section view of the shelf enclosure 20 taken along line A-A (see FIG. 1), according to a preferred embodiment of the present invention.
Figure 4:
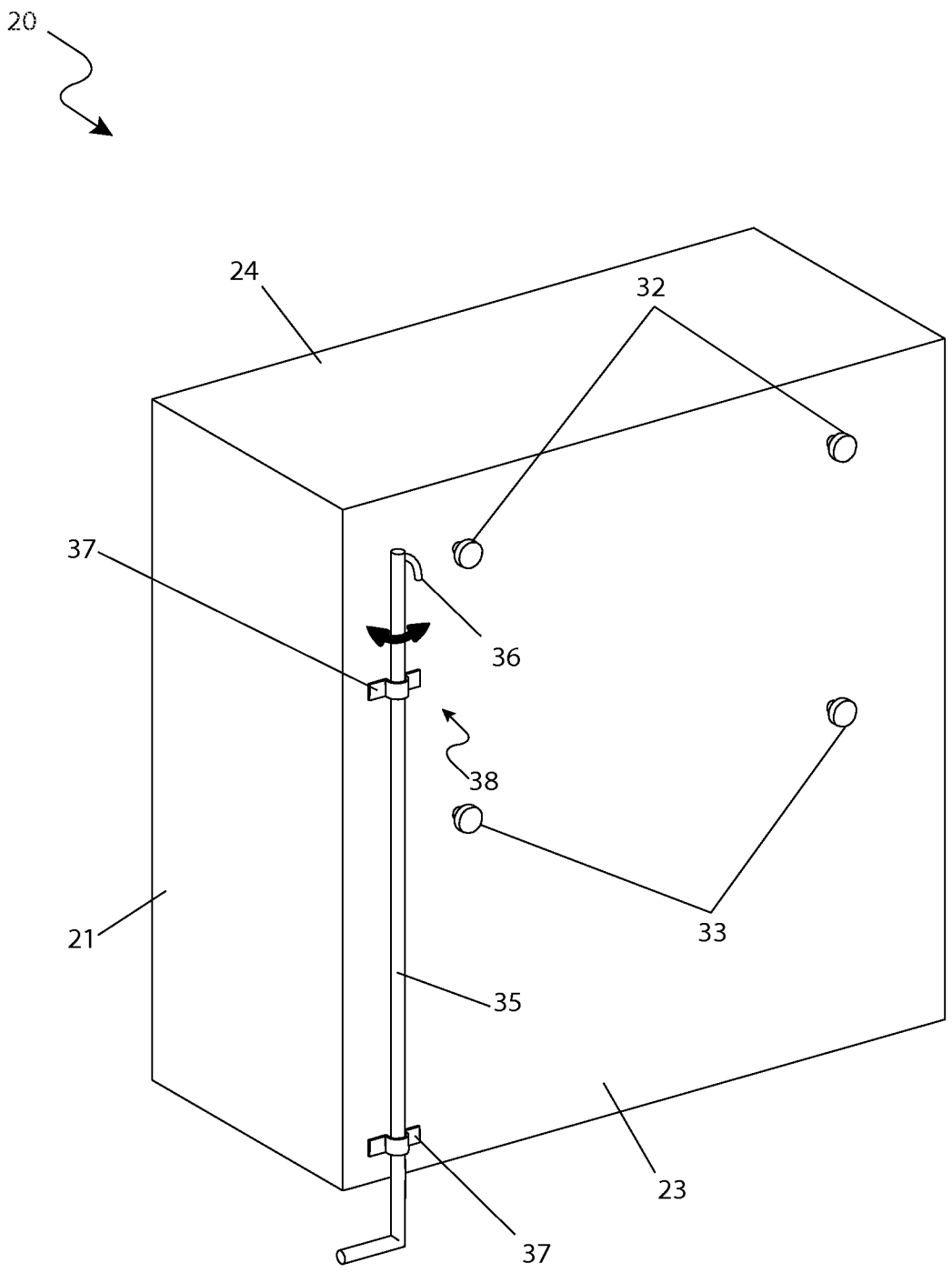
FIG. 4 is a rear perspective view of the shelf enclosure 20, according to a preferred embodiment of the present invention.

Referring now to FIG. 1, an environmental view of the apparatus 10, FIG. 2, another environmental view of the apparatus 10 depicting a deployed state, FIG. 3, a section view of the shelf enclosure 20 taken along line A-A (see FIG. 1), and FIG. 4, a rear perspective view of the shelf enclosure 20, according to the preferred embodiment of the present invention, are disclosed. The apparatus 10 comprises a shelf enclosure 20 which provides a means to secure desired items onto the apparatus 10. The shelf enclosure 20 comprises a rectangular body comprising an open front, a first side panel 21, a second side panel 22, a rear panel 23, an upper panel 24, a bottom panel 25, a pair of shelves 26, and a plurality of guide rails 30. The shelf enclosure 20 is depicted herein as comprising up to three (3) guide rails 30 located at lower, intermediate, and upper portions of said shelf enclosure 20 for illustration purposes only, it is known that fewer or more said guide rails 30 may be utilized without limiting the scope of the apparatus 10. Each guide rail 30 is comprised of a plurality of vertical members and a horizontal member which prohibit items from descending from the apparatus 10. Desired items to be displayed on the apparatus 10 are positioned behind each guide rail 30 and rest upon the bottom panel 25 and shelves 26. The guide rails 30 are positioned on a front surface of the bottom panel 25 and on each shelf 26 which is positioned perpendicularly subjacent to each said guide rail 30. The shelf enclosure 20 measures approximately thirty-two (32) inches wide by forty-eight (48) inches long by eight (8) inches deep. Each panel 21, 22, 23, 24, 25, shelf 26, and guide rails 30 are attached via common adhesive 31, yet other means of attachment such as, but not limited to: screws, welding, or the like may also be utilized without limiting the scope of the apparatus 10.

Figure 5:
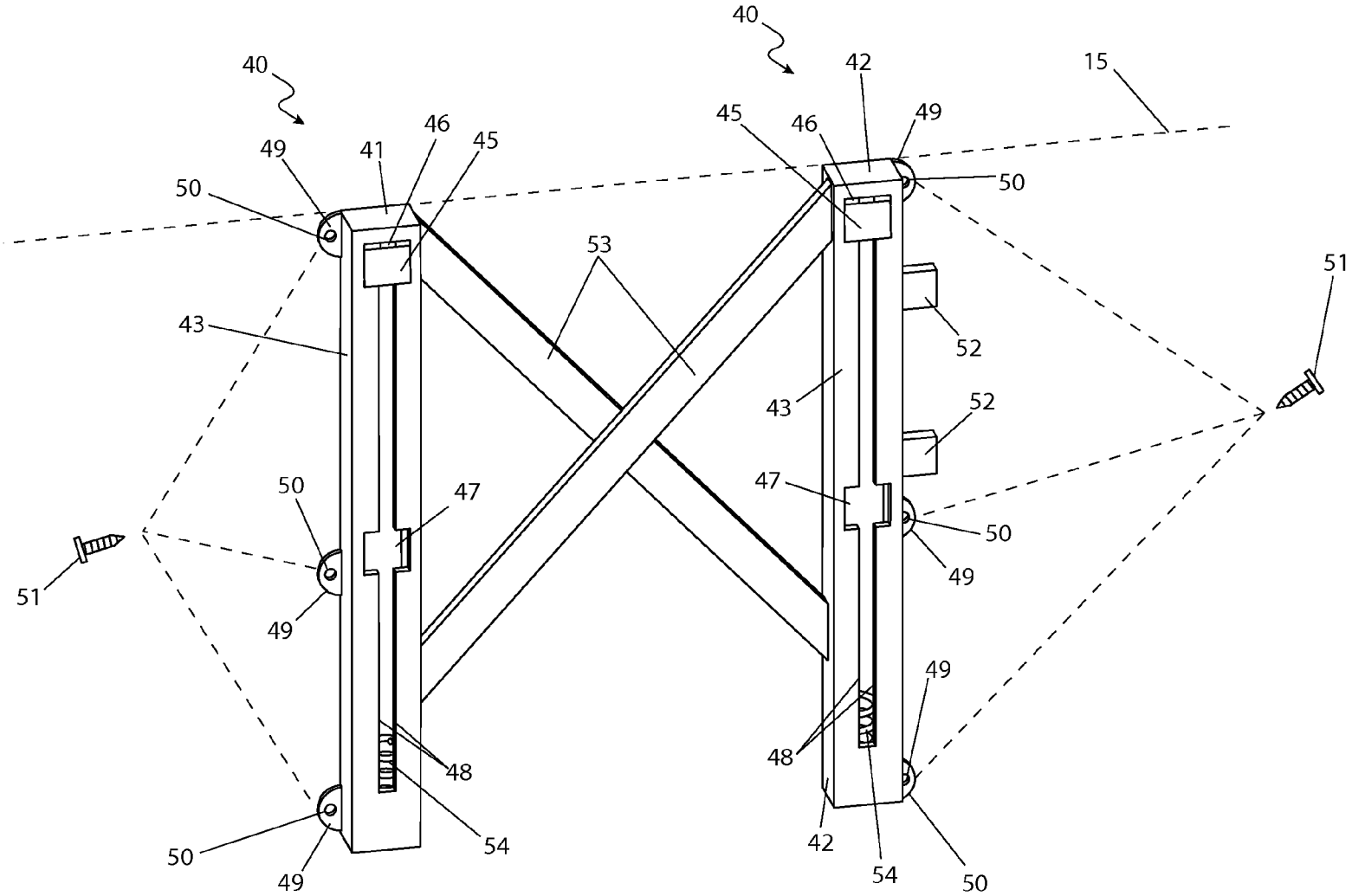
FIG. 5 is a perspective view of a track system 40 depicting an installed state, according to a preferred embodiment of the present invention.
Figure 7:
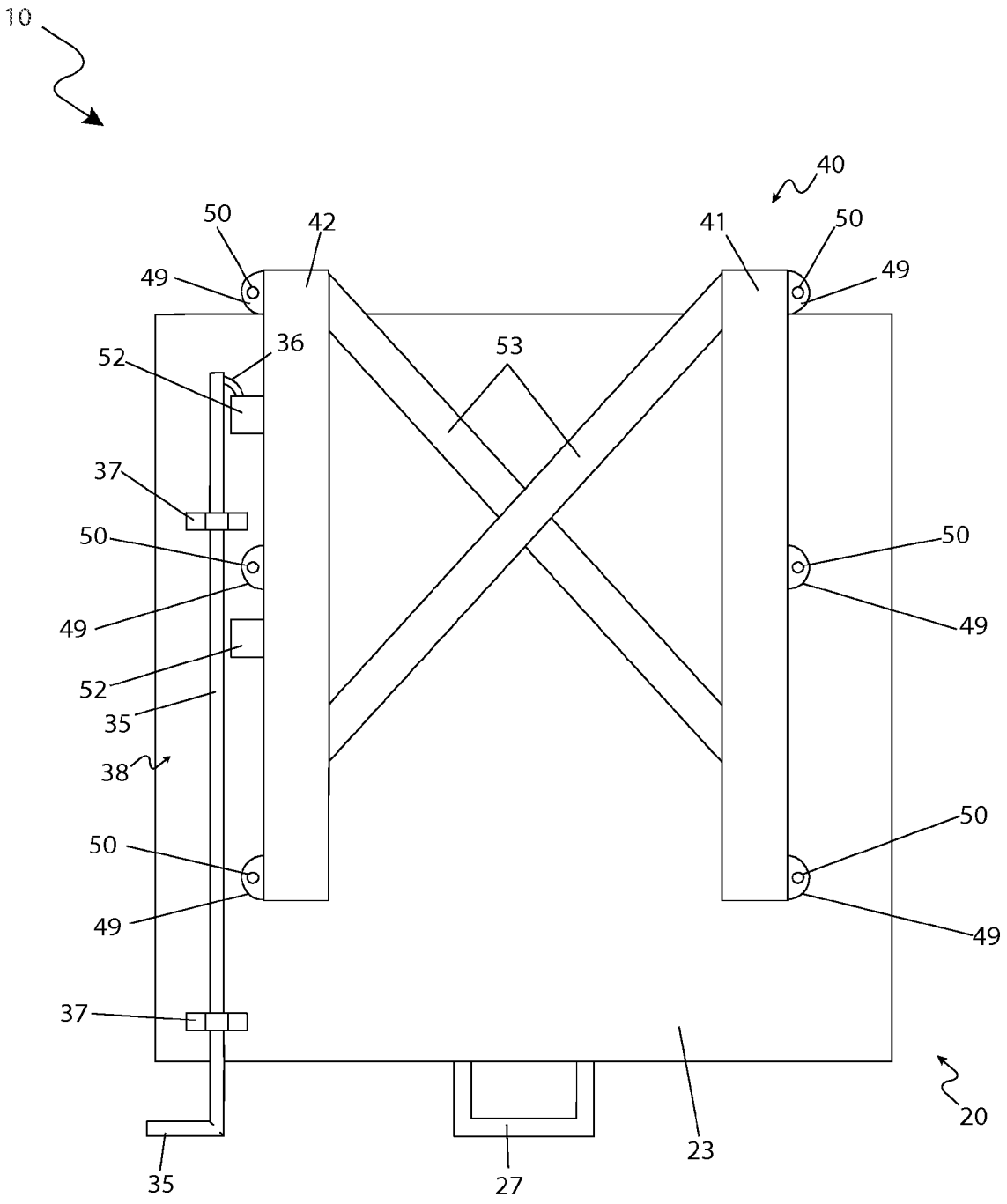

An underside surface of the bottom panel 25 comprises a handle 27 which provides a means to pull the shelf enclosure 20 downwardly upon a track system 40 (also see FIGS. 5 and 7). The handle 27 comprises a "U"-shaped body which enables the user to grasp said handle 27 and apply a downward force to the shelf enclosure 20, thereby positioning said shelf enclosure to a lowered position. In use, when the handle 27 is released the shelf enclosure 20 retracts to an original position via the track system 40. The handle 27 is attached to the bottom panel 25 via fastening means such as, but not limited to: screws, welding, or the like.

Figure 6:
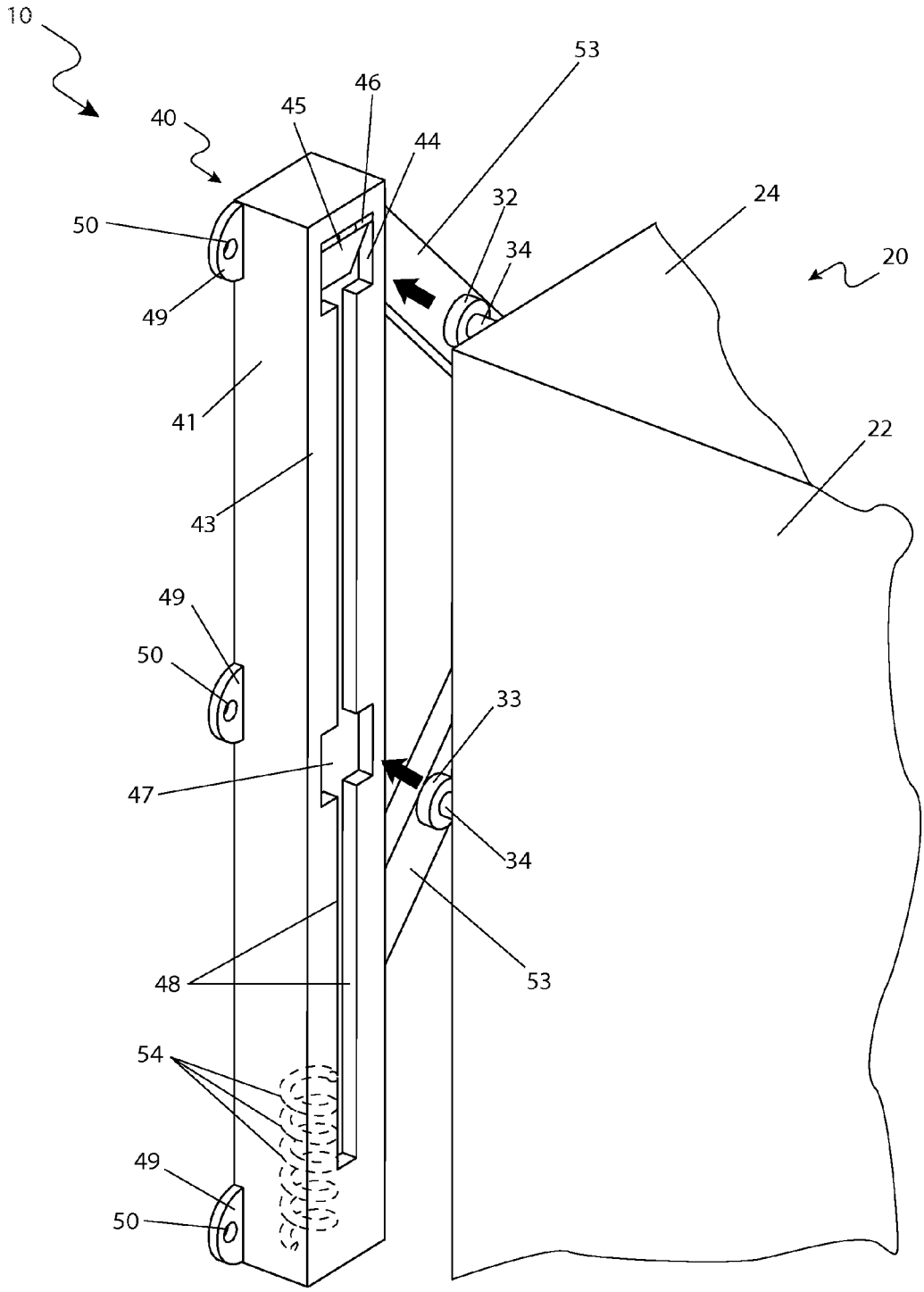
FIG. 6 is a perspective side view of the shelf enclosure 20 depicting placement within the track system 40, according to a preferred embodiment of the present invention; and, FIG. 7 is a rear view of the shelf enclosure 20 and track system 40 depicting a locking mechanism 38, according to a preferred embodiment of the present invention.

A rear surface of the shelf enclosure's 20 rear panel 23 comprises a pair of upper rollers 32 and a pair of lower rollers 33 which provide a means for said shelf enclosure 20 to engage the track system 40 for lowering and raising at a desired height (also see FIG. 6). The upper rollers 32 are located on an upper surface of the rear panel 23 and the lower rollers 33 are located on an intermediate position of the rear panel 23. Each roller 32, 33 comprises an axle 34 (see FIG. 6) which is integrally molded into the rear panel 23 and provides a fixed member for the rollers 32, 33 to rotate around.

A rear surface of the rear panel 23 also comprises a locking mechanism 38 which enables the shelf enclosure 20 to secure onto the track system 40 (also see FIG. 7). The locking mechanism 38 comprises a locking rod 35, a hook 36, and a pair of brackets 37 which enable the user to manually pivot said locking mechanism 38 to engage an outer surface of the track system 40, thereby securing the self enclosure 20 at a desired height. The locking rod 35 comprises an "L"-shape to enable the user to grasp a distal portion to rotate in a desired direction. The locking rod 35 also comprises a hook 36 on a proximal surface which comprises a hook-shape to engage a desired catch 53 located on an outer surface of a second enclosure 42 on the track system 40. The locking rod 35 is secured to the shelf enclosure 20 via a pair of brackets 37 which are preferably an arcuate-shaped integrally molded securing feature which enables the locking rod 35 to rotate clockwise or counterclockwise and to slightly extend upwardly or downwardly which assists the user in the placement of the hook 36 into a desired catch 52.

Referring now to FIG. 5, a perspective view of the track system 40 depicting an installed state, according to the preferred embodiment of the present invention, is disclosed. The apparatus 10 also comprises the track system 40 which enables the shelf enclosure 20 to be vertically manipulated to a desired height. The track system 40 is fixed to a desired vertical surface 15 corresponding to the desired placement of the shelf enclosure 20. The track system 40 comprises a first track enclosure 41, a second track enclosure 42, and a cross bar 53 which enable the shelf enclosure 20 to be mated and secured within said track system 40. Each track enclosure 41, 42 comprises a rectangular-shape and are fabricated from materials such as, but not limited to: metal, plastic, or the like. Each track enclosure 41, 42 also comprises a front surface 43 which further comprises a first opening 44, a second opening 47, a linear opening 48 which enable the shelf enclosure 20 to travel within the track system 40, and a spring 54 (see FIG. 6).

The first openings 44 located on each track enclosure 41, 42 are located at an upper location of the front surface 43 and comprise a rectangular-shape. Each first opening 44 accepts an upper roller 32. Each first opening 44 also comprises a panel 45 secured to said first opening 44 via a hinge 46 which is mounted to an upper perimeter surface of said first opening 44. Each panel 45 rotates inwardly and prohibits the upper roller 32 from being removed from the first opening 44 while in use via blocking said first opening 44 subsequent to insertion of the upper roller 32 into said first opening 44. Each first opening 44 is integrally molded into the front surface 43 and is further molded into each linear opening 48 (see herein below).

Each track enclosure 41, 42 also comprise a rectangular second opening 47 which provides an engaging mean to each lower roller 33. The upper rollers 32 and lower rollers 33 are inserted into the first opening 44 and second opening 47, respectively, in a simultaneous manner. Each second opening 47 is integrally molded into the linear opening 48 which is located on an intermediate surface of the front surface 43. The linear opening 48 enables each axle 34 to travel within and secures each roller 32, 33 within each track enclosure 41, 42.

Each track enclosure 41, 42 comprise support via a cross bar 53. The crossbar 53 is integrally molded to each inner perimeter surface of each track enclosure 41, 42 and provides structural stability to the apparatus 10 and enables the track enclosures 41, 42 to maintain approximately a sixteen (16) inch gap. The crossbar 53 is depicted as comprising an "X"-shape for illustration purposes only it is known that other structural stability members with various shapes may be utilized without limiting the scope of the apparatus 10.

Each outer perimeter edge of the track enclosures 41, 42 comprise a plurality of feet 49 which provide a securing means to the vertical surface 15. Each foot 49 comprises an arcuate shape which further comprises an aperture 50. The apertures 50 enable the insertion of a conventional fastener such as a screw which is further inserted into the vertical surface 15.

Referring now to FIG. 6, a perspective side view of the shelf enclosure 20 depicting placement within the track system 40 and FIG. 7, a rear view of the shelf enclosure 20 and track system 40 depicting the locking mechanism 38, according to the preferred embodiment of the present invention, are disclosed. FIG. 6 depicts the insertion of the rollers 32, 33 into the openings 44, 47. The track system 40 is preferably mounted to the desired vertical surface 15 prior to engaging the shelf enclosure 20 to said track system 40. Each roller 32, 33 engages the internal portion of each track enclosure 41, 42 via the openings 44, 47 which enables the rollers 32, 33 to be enclosed and further enabling each axle 34 to ride within the linear opening 48. An internal lower portion of each track enclosure 41, 42 comprises a spring 54 which is preferable a common compression spring, yet other elastic devices may be utilized without limiting the scope of the apparatus 10. The springs 54 are located below each second opening 47 and enable each lower roller 33 to rest upon said spring 54, thereby carrying the load of the apparatus 10 and added items which further prevents the shelf enclosure from unintentionally descending. Once each roller 32, 33 has been engaged within the track system 40 the locking mechanism 38 is engaged via rotating the locking rod 35 to engage the hook 36 into a desired catch 52. The second enclosure 42 comprises a pair of catches 52 which enables the shelf enclosure 20 to be secure in two (2) positions. Each catch 52 comprises a cup-shaped body which accepts the hook 36, yet other shapes may be utilized without limiting the scope of the apparatus 10. Each catch 52 is integrally molded into an outer side surface of the second track enclosure 42, yet other locations may be utilized without limiting the scope of the apparatus 10. It is known that a catch 52 should be positioned slightly above an intermediate location to prohibit the upper rollers 32 from an inadvertent removal out of the second openings 47.

It is envisioned that other styles and configurations of the present invention can be easily incorporated into the teachings of the present invention, and only one particular configuration shall be shown and described for purposes of clarity and disclosure and not by way of limitation of scope.

The preferred embodiment of the present invention can be utilized by the common user in a simple and effortless manner with little or no training. After initial purchase or acquisition of the apparatus 10, it would be installed as indicated in FIGS. 1 and 2.

The method of installing and utilizing the apparatus 10 may be achieved by performing the following steps: acquiring the apparatus 10; fastening the track system 40 onto a desired vertical surface 15 via inserting fasteners 51 into each aperture 50 on each foot 49; inserting each roller 32, 33 into each opening 44, 47, respectively and enabling each axle 34 to engage each linear opening 48; utilizing the handle 27 to deploy the shelf enclosure 20 downwardly via applying a force against each spring 54 which is located in each track enclosure 41, 42; grasping the locked rod 35 to engage the hook 36 into a desired catch 52, thereby locking the shelf enclosure 20 in a desired position; positioning desired items onto the bottom panel 25 or each shelf 26 behind the guide rails 30 as desired; utilizing the apparatus 10 as desired to store items; and, providing a unique solution to inaccessible storage space in a manner that is quick, easy, and effective.

The foregoing descriptions of specific embodiments of the present invention have been presented for purposes of illustration and description. They are not intended to be exhaustive or to limit the invention and method of use to the precise forms disclosed. Obviously many modifications and variations are possible in light of the above teaching. The embodiment was chosen and described in order to best explain the principles of the invention and its practical application, and to thereby enable others skilled in the art to best utilize the invention and various embodiments with various modifications as are suited to the particular use contemplated. It is understood that various omissions or substitutions of equivalents are contemplated as circumstance may suggest or render expedient, but is intended to cover the application or implementation without departing from the spirit or scope of the claims of the present invention.

What is claimed is:

1. A vertically retractable shelf system adapted to be mounted to a vertical surface for enabling a user to access items supported on said vertically retractable shelf system without use of a step stool or a ladder, said vertically retractable shelf system comprising:

a track system adapted to be mounted to the vertical surface, further comprising:

first and second track enclosures; and, a crossbar attached to an inner perimeter surface of each of said first and second track enclosures such that said first and second track enclosures maintain a fixed gap therebetween;

a shelf enclosure engaged to said track system, further comprising:

a plurality of panels configured to form an open front;

a plurality of shelves attached to selected ones of said panels;

a plurality of guide rails located at lower, intermediate, and upper portions of said shelf enclosure respectively, such that said shelves extend therebehind;

a handle located at a bottom one of said panels;

a plurality of upper and lower rollers located at a rear one of said panels; and, a plurality of axles integrally molded into said rear panel such that said upper and lower rollers rotate around said axles respectively; and, a locking mechanism attached to said shelf enclosure;

wherein each of said first and second track enclosures comprises:

a front surface;

a first opening located at an upper location of said front surface for accepting one of said upper rollers;

a second opening located at an intermediate location of said front surface for accepting one of said lower rollers; and, an enclosure panel pivotally secured to said first opening;

wherein said enclosure panel rotates inwardly and prohibits one of said upper rollers from being removed from said first opening;

wherein said upper and lower rollers slidably engage said track system and thereby lower and raise said shelf enclosure to a desired height;

wherein said locking mechanism engages an outer surface of said track system and thereby locks said shelf enclosure at the desired height along said track system; and, wherein said shelf enclosure automatically retracts to an original position along said track system when said locking mechanism is unlocked.

2. The vertically retractable shelf system of claim 1, wherein each of said guide rails comprises: a plurality of vertical and horizontal members positioned on a front surface of the bottom one of said panels and on each of said shelves respectively;

wherein said bottom panel and each of said shelves are positioned subjacent to said horizontal members respectively.

3. The vertically retractable shelf system of claim 1, wherein each of said first and second track enclosures further comprises:

a linear opening formed along said front surface, wherein corresponding ones of said axles travel along said linear opening; and, a spring located below said second opening;

wherein one of said lower rollers rests upon the corresponding one of said springs such that said springs carry a load of said vertically retractable shelf system; and, wherein said upper and lower rollers are slidably engaged within an internal portion of said first and second track enclosures.

4. The vertically retractable shelf system of claim 1, wherein each of said first and second track enclosures further comprises: a plurality of feet located at an outer perimeter edge of said track enclosure.

5. The vertically retractable shelf system of claim 1, wherein said locking mechanism is located at a rear surface of the rear panel of said shelf enclosure, said locking mechanism comprising:

an L-shaped locking rod;

a hook located on a proximal surface of said locking rod;

a plurality of brackets attached to said rear surface of said rear panel; and, a plurality of catches attached to said track system;

wherein said locking rod extends upwardly and downwardly through said brackets;

wherein said hook selectively engages said catches when said locking rod is rotated; and, wherein said shelf enclosure is locked at the desired height when said hook is selectively engaged with said catches.

6. A vertically retractable shelf system adapted to be mounted to a vertical surface for enabling a user to access items supported on said vertically retractable shelf system without use of a step stool or a ladder, said vertically retractable shelf system comprising:

a track system adapted to be mounted to the vertical surface, further comprising:

first and second track enclosures; and, a crossbar attached to an inner perimeter surface of each of said first and second track enclosures such that said first and second track enclosures maintain a fixed gap therebetween;

a shelf enclosure engaged to said track system, further comprising:

a plurality of panels configured to form an open front;

a plurality of shelves attached to selected ones of said panels;

a plurality of guide rails located at lower, intermediate, and upper portions of said shelf enclosure respectively such that said shelves extend therebehind;

a handle located at a bottom one of said panels;

a plurality of upper and lower rollers located at a rear one of said panels; and, a plurality of axles integrally molded into said rear panel such that said upper and lower rollers rotate around said axles respectively; and, a locking mechanism attached to said shelf enclosure;

wherein each of said first and second track enclosures comprises:

a front surface;

a first opening located at an upper location of said front surface for accepting one of said upper rollers;

a second opening located at an intermediate location of said front surface for accepting one of said lower rollers; and, an enclosure panel pivotally secured to said first opening;

wherein said enclosure panel rotates inwardly and prohibits one of said upper rollers from being removed from said first opening;

wherein said upper and lower rollers slidably engage said track system and thereby lower and raise said shelf enclosure to a desired height;

wherein said locking mechanism pivots to engage an outer surface of said track system and thereby locks said shelf enclosure at the desired height along said track system; and, wherein said shelf enclosure automatically retracts to an original position along said track system when said locking mechanism is unlocked.

7. The vertically retractable shelf system of claim 6, wherein each of said guide rails comprises: a plurality of vertical and horizontal members positioned on a front surface of the bottom one of said panels and on each of said shelves respectively;

wherein said bottom panel and each of said shelves are positioned subjacent to said horizontal members respectively.

8. The vertically retractable shelf system of claim 6, wherein each of said first and second track enclosures further comprises:

a linear opening formed along said front surface, wherein corresponding ones of said axles travel along said linear opening; and, a spring located below said second opening;

wherein one of said lower rollers rests upon the corresponding one of said springs such that said springs carry a load of said vertically retractable shelf system; and, wherein said upper and lower rollers are slidably engaged within an internal portion of said first and second track enclosures.

9. The vertically retractable shelf system of claim 6, wherein each of said first and second track enclosures further comprises: a plurality of feet located at an outer perimeter edge of said track enclosure.

10. The vertically retractable shelf system of claim 6, wherein said locking mechanism is located at a rear surface of the rear panel of said shelf enclosure, said locking mechanism comprising:

an L-shaped locking rod;

a hook located on a proximal surface of said locking rod;

a plurality of brackets attached to said rear surface of said rear panel; and, a plurality of catches attached to said track system;

wherein said locking rod extends upwardly and downwardly through said brackets;

wherein said hook selectively engages said catches when said locking rod is rotated; and, wherein said shelf enclosure is locked at the desired height when said hook is selectively engaged with said catches.

* * * * *